US011560284B2

(12) United States Patent
Morita

(10) Patent No.: US 11,560,284 B2
(45) Date of Patent: Jan. 24, 2023

(54) SHEET DISCHARGE DEVICE AND IMAGE FORMING APPARATUS

(71) Applicant: KYOCERA Document Solutions Inc., Osaka (JP)

(72) Inventor: Takuro Morita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 9 days.

(21) Appl. No.: 17/343,562

(22) Filed: Jun. 9, 2021

(65) Prior Publication Data

US 2021/0387826 A1 Dec. 16, 2021

(30) Foreign Application Priority Data

Jun. 12, 2020 (JP) ..... JP2020-102194

(51) Int. Cl.
*B65H 29/14* (2006.01)
*B65H 29/66* (2006.01)
*B65H 43/00* (2006.01)

(52) U.S. Cl.
CPC ..... *B65H 29/6609* (2013.01); *B65H 29/14* (2013.01); *B65H 43/00* (2013.01)

(58) Field of Classification Search
CPC .... B65H 29/6609; B65H 29/14; B65H 43/00; B65H 31/00; B65H 31/02; B65H 2301/4219; B65H 33/08; B65H 33/06
See application file for complete search history.

(56) References Cited

U.S. PATENT DOCUMENTS 5,513,839 A * 5/1996 Green ..... B42B 5/00 271/221
8,448,943 B2 * 5/2013 Prabhat ..... B65H 7/02 271/227
2007/0102874 A1 * 5/2007 Matsutomo ..... B65H 39/10 271/286
2012/0049441 A1 * 3/2012 Kimura ..... B65H 33/08 271/223
2017/0298999 A1 * 10/2017 Kadowaki ..... B65H 29/14

FOREIGN PATENT DOCUMENTS

JP H08-208098 A 8/1996
JP 2007-112612 A 5/2007

* cited by examiner

*Primary Examiner* — Thomas A Morrison
(74) *Attorney, Agent, or Firm* — Studebaker & Brackett PC

(57) ABSTRACT

A sheet discharge device includes a discharge member and a control part. When a sheet is discharged to a first offset position, the control part shifts the discharge member to a first reception position separated from a home position in a second direction by a second distance shorter than a first distance, and shifts the discharge member to a first discharge position separated from the first reception position in the first direction by the first distance after the sheet is received. When the sheet is discharged to a second offset position, the control part shifts the discharge member to a second reception position separated from the home position in the first direction by the second distance, and shifts the discharge member to a second discharge position separated from the second reception position in the second direction by the first distance after the sheet is received.

9 Claims, 3 Drawing Sheets

SHEET DISCHARGE DEVICE AND IMAGE FORMING APPARATUS

INCORPORATION BY REFERENCE

This application is based on and claims the benefit of priority from Japanese Patent application No. 2020-102194 filed on Jun. 12, 2020, which are incorporated by reference in its entirety.

TECHNICAL FIELD

The present disclosure relates to a sheet discharge device which shifts a sheet in a width direction for each sheet stack (copy) and then discharges it and an image forming apparatus including the sheet discharge device.

A conventional sheet discharge device of an image forming apparatus is sometimes configured to sort the sheet stacks on a discharge tray by shifting a sheet in a width direction for each sheet stack and then discharging it on the discharge tray. For example, such a sheet discharge device includes a discharge rollers pair movable in the width direction, and the sheets are stacked at different offset positions on the discharge tray for each sheet stack by moving the discharge rollers pair in the width direction and then discharging the sheets.

SUMMARY OF THE INVENTION

In accordance with one aspect of the present disclosure, a sheet discharge device sorts discharged sheets for each copy. The sheet discharge device includes a conveyance member, a discharge member, a shift part, and a control part. The conveyance member conveys a sheet in a predetermined conveyance direction. The discharge member is shiftable in a width direction crossing to the conveyance direction and discharges the sheet conveyed from the conveyance member to a discharge tray. The shift part is configured to shift the discharge member in the width direction. The control part is configured to carry out a sort processing where the sheets conveyed from the conveyance member are alternately discharged to a first offset position and a second offset position for each copy. The first offset position and the second offset position are separated from a reference discharge position by a first distance each other in a first direction and in a second direction opposite to the first direction in the width direction. In a case where the sheet is discharged to the first offset position, the control part shifts the discharge member to a first reception position separated from a home position in the second direction by a second distance shorter than the first distance, shifts the discharge member to a first discharge position separated from the first reception position in the first direction by the first distance after the sheet is received by the discharge member, and then discharges the sheet to the first offset position. In a case where the sheet is discharged to the second offset position, the control part shifts the discharge member to a second reception position separate from the home position in the first direction by the second distance, shifts the discharge member to a second discharge position separated from the second reception position in the second direction by the first distance after the sheet is received by the discharge member, and then discharges the sheet to the second offset position.

In accordance with one aspect of the present disclosure, an image forming apparatus includes an image forming apparatus forming an image on a sheet; and the sheet discharge member which discharges the sheet on which the image is formed in the image forming part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus and a sheet discharge device according to one embodiment of the present disclosure will be described.

Figure 1:
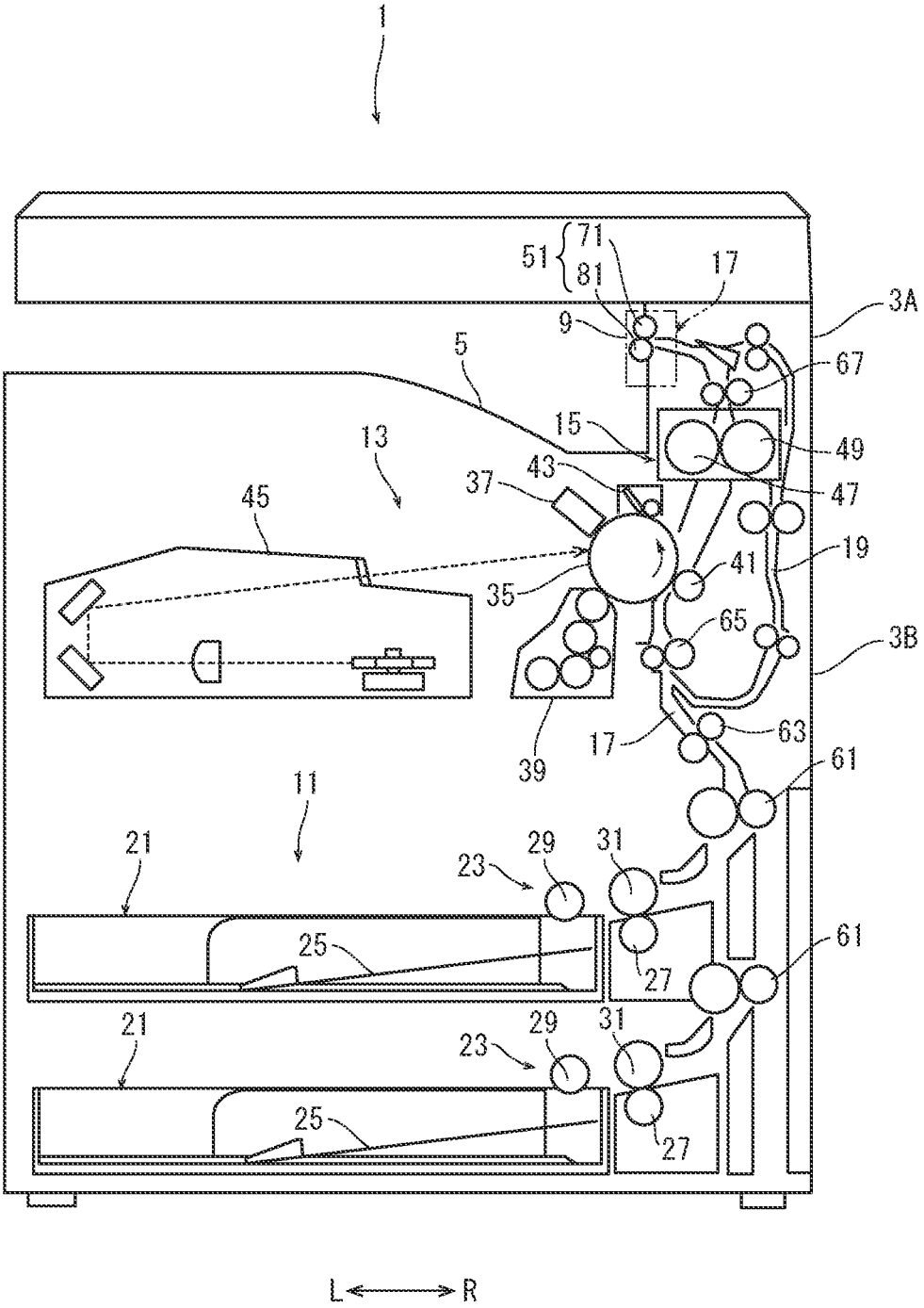
FIG. 1 is a front view schematically showing an image forming apparatus according to one embodiment of the present disclosure.

First, with reference to FIG. 1, the image forming apparatus will be described. FIG. 1 is a front view schematically showing an inner structure of the image forming apparatus. Hereinafter, a front side of a paper plane on which FIG. 1 is drawn is defined as a front side of the image forming apparatus. Fr, Rr, L and R marked in each drawing indicate a front side, a rear side, a left side and a right side of the image forming apparatus, respectively.

The image forming apparatus 1 includes an upper housing 3A and a lower housing 3B each having a parallelepiped shaped hollow space. The upper housing 3A is connected to the right end portion of the upper face of the lower housing 3B, and the hollow spaces of the upper and lower housings 3A and 3B are communicated with each other. On the top plate of the lower housing 3B, a discharge tray 5 inclined upward from the left side to the right side is formed.

In the hollow space of the lower housing 3B, a sheet feeding part 11, an image forming part 13 and a fixing unit 15 are stored, and in the hollow space of the upper housing 3A, a sheet discharge device 17 is stored. In the hollow spaces of the upper and lower housings 3A and 3B, a main conveyance path 18 and an inversion path 19 along which the sheet is conveyed are formed.

The sheet feeding part 11 includes two sheet feeding cassettes 21 and two sheet feeding units 23, and are stored in the lower portion of the hollow space. The two sheet feeding cassettes 21 are disposed in parallel in the upper-and-lower direction, and are attachable to and detachable from the hollow space through an opening formed in the front plate of the lower housing 3B. Each sheet feeding cassette 21 includes a placement plate 25 on which the sheet is placed and a retard roller 27.

The sheet feeding unit 23 includes a pickup roller 29 and a feed roller 31. The pickup roller 29 comes into contact with the sheet placed on the placement plate 25 and then rotates. The feed roller 31 comes into contact with the retard roller 27 to form a separation nip between both rollers 31 and 27.

The Image forming part 13 is disposed above the sheet feeding part 11, and includes a photosensitive drum 35, a charging unit 37, a development unit 39, a transferring roller 41, a cleaning unit 43 and an exposure unit 45. The photosensitive drum 35 is rotatable in the counterclockwise direction in FIG. 1. The charging unit 37, the development unit 39, the transferring roller 41 and the cleaning unit 43 are disposed around the photosensitive drum 35 in order along the rotational direction of the photosensitive drum 35.

The fixing unit 15 is disposed above the image forming part 13, and includes a fixing roller 47 and a pressing roller 49.

The sheet discharge device 17 includes a discharge rollers pair 51 and a shift part 53 (not shown in FIG. 1) which shifts the discharge rollers pair 51 in a width direction perpendicular to a sheet conveyance direction. The sheet discharge device 17 will be described below.

The main conveyance path 18 is formed so as to extend from each separation nip of the sheet feeding part 11 to the sheet discharge device 17 through a transferring nip between the photosensitive drum 35 and the transferring roller 41 and the fixing unit 15. The sheet conveyance direction shows a direction in which the sheet is conveyed along the main conveyance path 18. In the following description, an upstream side and a downstream side show an upstream side and a downstream side in the sheet conveyance direction. The inversion path 19 is branched from the main conveyance path 18 on the downstream side of the fixing unit 15 and joined to the main conveyance path 18 on the downstream side of the sheet feeding part 11.

On the main conveyance path 18, an intermediate rollers pair 61, a conveyance rollers pair 63, a resist rollers pair 65 and a fixing discharge rollers pair 67 are disposed in order from the upstream side. The intermediate rollers pair 61 is disposed on the downstream side of the separation nips of the sheet feeding part 11. The conveyance rollers pair 63 is disposed on the upstream side of a joining portion between the inversion path 19 and the main conveyance path 18. The resist rollers pair 65 is disposed on the upstream side of the transferring nip of the image forming part 13. The fixing discharge rollers pair 67 is disposed on the downstream side of the fixing unit 15. The fixing discharge rollers pair 67 is an example of a conveyance member which conveys the sheet in the predetermined conveyance direction.

Next, an image forming operation will be described. First, in the image forming part 13, the charging unit 37 charges the photosensitive drum 35, and the exposure unit 45 exposes the photosensitive drum 35 based on an image data. Thus, an electrostatic latent image is formed on the photosensitive drum 35. The development unit 39 develops the electrostatic latent image in a toner image. On the other hand, in the sheet feeding part 11, the sheet placed on the placement plate 25 of the sheet feeding cassette 21 is fed by the pickup roller 29, is separated at the separation nip, and then is conveyed to the main conveyance path 18. The sheet is then conveyed by the intermediate rollers pair 61 and the conveyance rollers pair 63, and is conveyed to the transferring nip after a conveyance timing is adjusted by the resist rollers pair 65.

At the transferring nip, the toner image formed on the photosensitive drum 35 is transferred to the sheet. Thereafter, the sheet is conveyed to the fixing unit 15. The fixing unit 15 fixes the toner image to the sheet. The sheet on which the toner image is fixed is conveyed to the sheet discharge device 17 by the fixing discharge rollers pair 67. The sheet discharge device 17 discharges the sheet to the discharge tray 5. The discharged sheets are stacked on the discharge tray 5. The toner remaining on the photosensitive drum 35 after the toner image is transferred to the sheet is removed by the cleaning unit 43.

Figure 2:
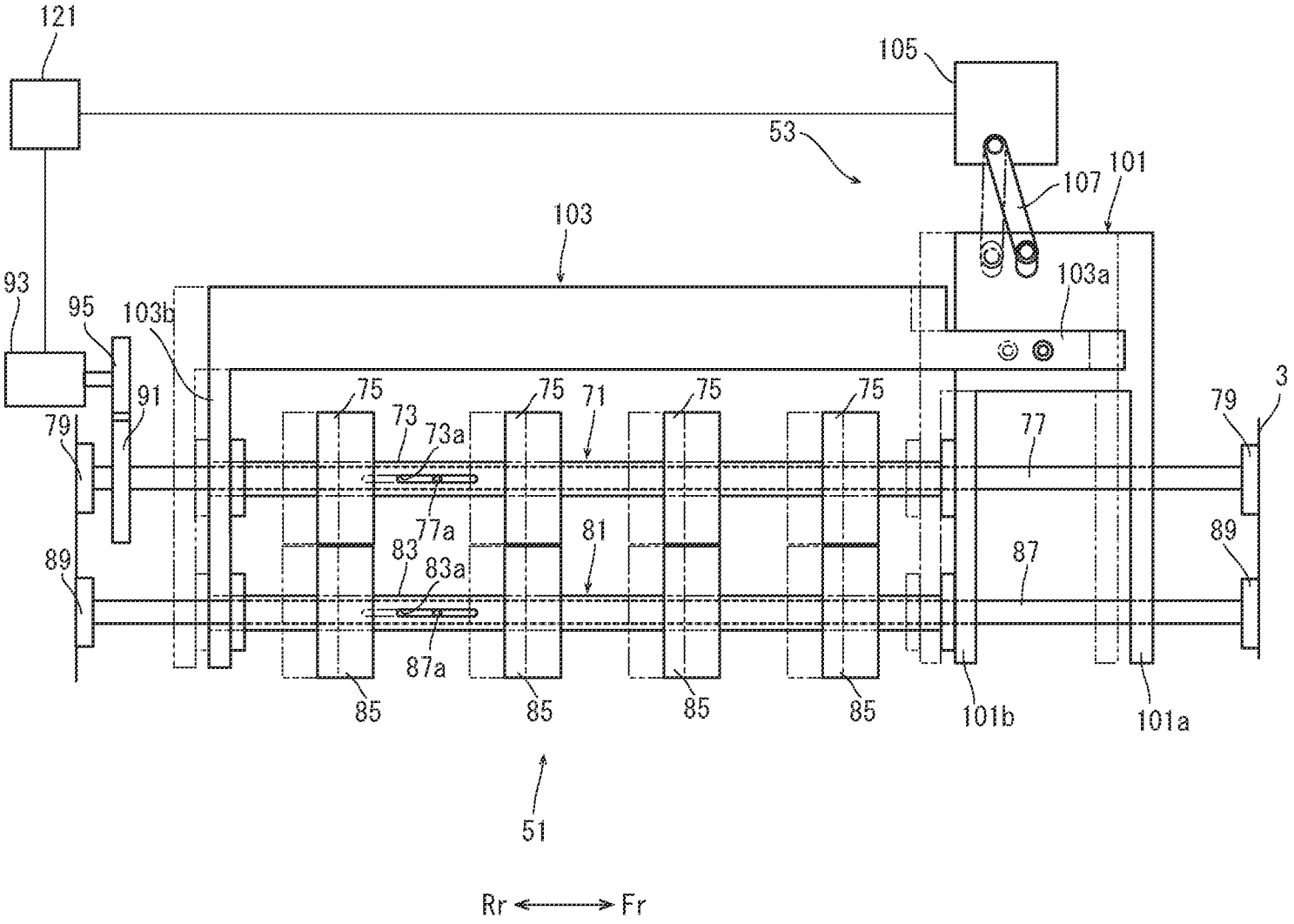
FIG. 2 is a front view showing a shift part of a sheet discharge device according to the embodiment of the present disclosure.

Next, the sheet discharge device 17 will be described with reference to FIG. 1 and FIG. 2. FIG. 2 is a front view schematically showing the discharge rollers pair and the shift part.

The sheet discharge device 17 includes the discharge rollers pair 51 and the shift part 53 (refer to FIG. 2, not shown in FIG. 1) which shifts the discharge rollers pair 51 in the width direction, as described above. The discharge rollers pair 51 is an example of a discharge member shiftable in the width direction crossing to the conveyance direction and discharging the sheet conveyed from the conveyance member (the fixing discharge rollers pair 67) on the discharge tray 5, and the shift part 53 is an example of a shift part configured to shift the discharge member (the discharge rollers pair 51) in the width direction.

The discharge rollers pair 51 includes a first roller 71 and a second roller 81 as shown in FIG. 1 and FIG. 2.

As shown in FIG. 2, the first roller 71 includes a first rotational shaft 73, a plurality of (four, in the embodiment) first roller bodies 75 and a first drive shaft 77, and the second roller 81 includes a second rotational shaft 83, a plurality of (four, in the embodiment) second roller bodies 85 and a second drive shaft 87. The first and second rotational shafts 73 and 83 are formed in a hollow cylindrical shape. The first and second rotational shafts 73 and 83 have long holes 73*a* and 83*a* along the axial directions of the first and second rotational shafts 73 and 83. The first and second rotational bodies 75 and 85 are fixed to portions other than the long holes 73*a* and 83*a* at predetermined intervals in the axial directions, and rotate together with the first and second rotational shafts 73 and 83.

The first and second drive shafts 77 and 87 penetrate the inner spaces of the first and second rotational shafts 73 and 83. The first and second drive shafts 77 and 87 has pins 77*a* and 87*a* insertable into the long holes 73*a* and 83*a* of the first and second rotational shafts 73 and 83. By inserting the pins 77*a* and 87*a* of the first and second drive shafts 77 and 87 into the long holes 73*a* and 83*a* of the first and second rotational shafts 73 and 83, the first and second rotational shafts 73 and 83 are prevented from being rotated relative to the first and second drive shafts 77 and 87. Further, the first and second rotational shafts 73 and 83 are shiftable relative to the first and second drive shafts 77 and 87 in the axial directions by lengths of the long holes 73*a* and 83*a*.

The first and second rollers 71 and 81 are disposed in parallel in the upper-and-lower direction such that the first and second roller bodies 75 and 85 comes into contact with each other to form nip portions between the first and second rotational bodies 75 and 85. Both end portions of the first and second drive shafts 77 and 87 are supported by front and rear side plates of the upper housing 3A with bearings 79 and 89 in a rotatable manner.

To the rear end portion of the first drive shaft 77 of the first roller 71, an input gear 91 is fixed. The input gear 91 is meshed with an output gear 95 fixed to an output shaft of a drive shaft rotating motor 93. The drive shaft rotating motor 93 is electrically connected to a control part 121, and is controlled by the control part 121 to be driven. When the drive shaft rotating motor 93 is driven to rotate the output shaft, the first drive shaft 77 of the first roller 71 is rotated via the output gear 95 and the input gear 91. Then, the first rotational shaft 73 is rotated together with the first drive shaft 77, and the first roller 71 is rotated. Further, the second roller 81 is driven by the first roller 71 to be rotated. As a result, the sheet conveyed between the first and second rollers 71 and 81 (the nip portions between the first and second roller bodies 75 and 85) is discharged.

The shift part 53 includes a movable block 101, a link plate 103, and a block moving motor 105. The movable block 101 has front and rear leg portions 101*a* and 101*b* separated from each other in the axial direction. The front and rear leg portions 101*a* and 101*b* each has upper and lower through holes. The upper and lower through holes each has an inner diameter larger than outer diameters of the first and second drive shafts 77 and 87 of the first and second rollers 71 and 81. The front end portions of the first and second drive shafts 77 and 87 of the first and second rollers 71 and 81 are inserted into the through holes of the front and rear leg portions 101*a* and 101*b*. The front end portions of the first and second rotational shafts 73 and 83 of the first and second rollers 71 and 81 come into contact with the rear leg portion 101*b* via washers.

The link plate 103 couples the movable block 101 to the first and second rollers 71 and 81. The link plate 103 has a fixed piece 103*a* fixed to the movable block 101 and a connection piece 103*b* connected to the first and second drive shafts 77 and 87 of the first and second rollers 71 and 81. The connection piece 103*b* has upper and lower through holes. The upper and lower through holes each has an inner diameter larger than the outer diameters of the first and second drive shafts 77 and 87. The rear end portions of the first and second drive shafts 77 and 87 of the first and second rollers 71 and 81 are inserted into the through holes of the connection piece 103*b*. The rear end portions of the first and second rotational shafts 73 and 83 of the first and second rollers 71 and 81 come into contact with the connection piece 103*b* via washers. In the above manner, the first and second rollers 71 and 81 are held between the rear leg portion 101*b* of the movable block 101 and the connection piece 103*b* of the link plate 103.

To an output shaft of the block moving motor 105, one end of a turning piece 107 is fixed. The other end of the turning piece 107 is coupled to the movable block 101 in a rotatable manner. The block moving motor 105 is electrically connected to the control part 121, and is controlled by the control part 121 to be driven. When the block moving motor 105 is driven to turn the turning piece 107, the movable block 101 is moved along the first and second drive shafts 77 and 87 in the axial direction in a reciprocating manner. Then, the link plate 103 is moved together with the movable block 101 in a reciprocating manner, and the first and second rollers 71 and 81 held between the movable block 101 and the link plate 103 are shifted in the axial direction in a reciprocating manner. By shifting the first and second roller 71 and 81 in the axial direction, it becomes possible to change a position where the sheet is discharged by the discharge rollers pair 51 (a position where the sheet is stacked on the discharge tray 5) in the width direction.

Figure 3:
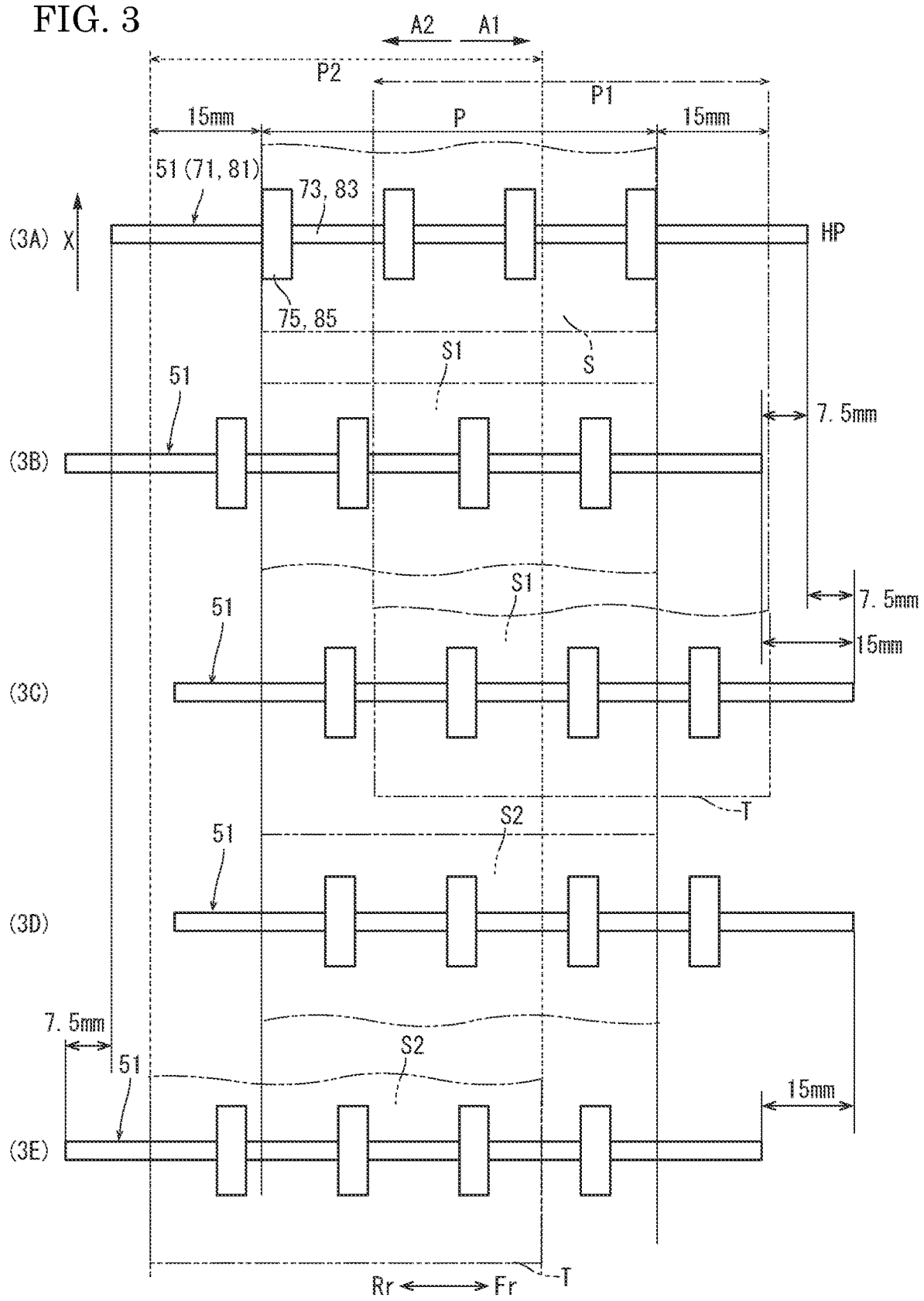
FIG. 3 is a view explaining a position of a discharge rollers pair at a time of a sheet discharging, in the sheet discharge device according to the embodiment of the present disclosure.

A sheet discharge operation of the sheet discharge device 17 having the above configuration will be described with reference to FIG. 3 (3A, 3B, 3C and 3D). FIG. 3 is a view schematically showing a position of the discharge rollers pair. FIG. 3 shows the discharge rollers pair schematically.

Here, a sort processing where the discharged sheets are sorted on the discharge tray 5 by stacking a first copy and a second copy at a first offset position P1 and at a second offset position P2 which are separated from each other by 30 mm in the width direction on the discharge tray 5 will be described. The first offset position P1 is a position separated forward (a first direction, see the arrow A1 in FIG. 3) from a reference discharge position P by 15 mm (a first distance), and the second offset position P2 is a position separated rearward (a second direction, see the arrow A2 in FIG. 3) from the reference discharge position P by 15 mm (the first distance). The above offset processing is carried out by controlling the block moving motor 105 of the shift part 53 and the drive shaft rotating motor 93 for the discharge rollers pair 51 by the control part 121.

As shown in FIG. 3A, the discharge rollers pair 51 is on standby at the home position HP. The sheet S is conveyed to the discharge rollers pair 51 by the fixing discharge rollers pair 67 (see FIG. 1, not shown in FIG. 3). The sheet S is nipped between the four first and second roller bodies 75 and 85 of the first and second rollers 71 and 81 of the discharge rollers pair 51, and is discharged at the reference discharge position P on the discharge tray 5 by rotating the first and second rollers 71 and 81.

When the sheet S1 of the first copy is discharged, before the sheet S1 is conveyed from the fixing discharge rollers pair 67 to the discharge rollers pair 51 (before the sheet S1 is nipped by the discharge rollers pair 51), as shown in FIG. 3B, the shift part 53 (see FIG. 2) shifts the discharge rollers pair 51 to a first reception position separated from the home position HP rearward (in the second direction A2) by 7.5 mm (a second distance) shorter than the first distance (15 mm, in the embodiment). In other words, the discharge rollers pair 51 is shifted to an opposite direction to the first offset position P1 relative to the home position HP.

As shown in FIG. 3B, the sheet S1 conveyed to the discharge rollers pair 51 from the fixing discharge rollers pair 67 is nipped by the discharge rollers pair 51 shifted to the first reception position (a position separated from the home position HP rearward by 7.5 mm). In this case, as shown in FIG. 3B, the sheet S is nipped by the three first and second roller bodies 75 and 85 of the first and second roller 71 and 81 of the discharge rollers pair 51.

As shown in FIG. 3C, after the tail edge of the sheet S1 passes the fixing discharge rollers pair 67, the shift part 53 shifts the discharge rollers pair 51 to a first discharge position separated from the first reception position forward (in the first direction A1) by 15 mm (the first distance). In other words, the discharge rollers pair 51 is shifted forward from the home position HP by 7.5 mm. On the other hand, the sheet S1 is shifted forward relative to the reference discharge position P by 15 mm. After that, the first and second rollers 71 and 81 of the discharge rollers pair 51 are rotated to discharge the sheet S1 on the discharge tray 5 (see FIG. 1). The discharged sheet S1 is stacked at the first offset position P1 on the discharge tray 5. Then, the discharge rollers pair 51 is shifted to the home position HP. Here, when the first copy contains a number of the sheets, the discharge rollers pair 51 may be shifted to a position separated rearward (the second direction A2) from the home position HP by 7.5 mm (the second distance). The above operation is carried out by a predetermined number of the sheet of the copy, and the sheets S1 of the first copy are staked at the first offset position P1.

When the sheet S2 of the second copy is discharged next (after the last sheet S1 of the first copy is discharged), the discharge rollers pair 51 is not shifted to the home position HP from the first discharge position shown in FIG. 3C. That is, the discharge rollers pair 51 has been shifted forward from the home position HP by 7.5 mm. In other words, the discharge rollers pair 51 has been shifted in an opposite direction to the second offset position P2 relative to the home position HP.

As shown in FIG. 3D, the sheet S2 conveyed to the discharge rollers pair 51 from the fixing discharge rollers pair 67 is nipped by the discharge rollers pair 51 shifted to the first discharge position (a position separated from the home position HP forward by 7.5 mm). In other words, the sheet S2 conveyed to the discharge rollers pair 51 from the fixing discharge rollers air 67 is nipped by the discharge rollers pair 51 shifted to a second reception position (a position separated from the home position HP forward by 7.5 mm). As described above, in the sort processing for sorting the sheets of the first copy and the sheets of the second copy, like the present embodiment, the first discharge position where the discharge rollers pair 51 discharges the sheets of the first copy is the same as the first reception position where the discharge rollers pair 51 receives the sheets of the second copy. In this case, as shown in FIG. 3D, the sheet S2 is nipped by the three first and second roller bodies 75 and 85 of the first and second rollers 71 and 81 of the discharge rollers pair 51.

As shown in FIG. 3E, after the tail edge T of the sheet S2 passes the fixing discharge rollers pair 67, the shift part 53 shifts the discharge rollers pair 51 to a second discharge position separated from the second reception position (the first discharge position) rearward (in the second direction A2) by 15 mm (the first distance). In other words, the discharge rollers pair 51 is shifted rearward from the home position HP by 7.5 mm. On the other hand, the sheet S1 is shifted rearward relative to the reference discharge position P by 15 mm. After that, the first and second rollers 71 and 81 of the discharge rollers pair 51 are rotated to discharge the sheet S2 on the discharge tray 5 (see FIG. 1). The discharged sheet S1 is stacked at the second offset position P2 on the discharge tray 5. Then, the discharge rollers pair 51 is shifted to the home position HP. Here, when the second copy contains a number of the sheets, the discharge rollers pair 51 may be shifted to a position separated forward (the first direction A1) from the home position HP by 7.5 mm (the second distance). The above operation is carried out by a predetermined number of the sheet of the second copy, and the sheets S2 of the second copy are staked at the second offset position P2.

In the above manner, the sheets S1 of the first copy and the sheets S2 of the second copy alternately stacked at the first offset position P1 and the second offset position P2 which are separated from each other in the width direction by 30 mm.

As described above, according to the sheet discharge device 17 in the present disclosure, by previously shifting the discharge rollers pair 51 in an opposite direction to the offset position before the sheet is conveyed to the discharge rollers pair 51 from the fixing discharge rollers pair 67, it becomes possible to decrease a shift distance of the discharge rollers pair 51 for discharging the sheet on the corresponding offset position.

When the discharge rollers pair 51 is positioned at the home position HP and discharges the sheet to the reference discharge position P, the sheet S is nipped by all (four) first and second roller bodies 75 and 85 of the first and second rollers 71 and 81 (see FIG. 3A). On the other hand, as shown in FIG. 3B and subsequent drawings, when the discharge rollers pair 51 is shifted from the home position HP by the second distance before the sheet is nipped by the discharge rollers pair 51, the sheets S1 and S2 are nipped by the three first and second roller bodies 75 and 85 of the first and second rollers 71 and 81. As described above, compared with the case where the discharge rollers pair 51 discharge the sheet S to the reference discharge position P at the home position HP, the number of the roller bodies for nipping the sheets S1 and S2 is decreased, but if the number of the roller bodies for nipping the sheets S1 and S2 is at least two, in other words, the number of the nip portion is at least two, the sheets S1 and S2 can be nipped stably.

The second distance is preferably equal to or less than an interval between the first and second roller bodies 75 and 85 of the first and second rollers 71 and 81 of the discharge rollers pair 51. In this case, when the discharge rollers pair 51 is shifted by the second distance, the number of the first and second roller bodies 75 and 85 for nipping the sheet can be increased as much as possible, so that the sheet can be stably nipped and then discharged.

In this embodiment, the shift distance (the second distance, 7.5 mm in this embodiment) of the discharge rollers pair 51 before the sheets S1 and S2 are held by the discharge rollers pair 51 is ½ of the distance (the first distance, 15 mm in this embodiment) between the reference discharge position P and each of the first and second offset positions P1 and P2, and the shift distances of the discharge rollers pair 51 forward (the first direction) and rearward (the second direction) are equal. Therefore, when the discharge rollers pair 51 is shifted forward and backward, the number of the roller bodies 75 and 85 for nipping the sheets S1 and S2 becomes equal. Therefore, it becomes possible to discharge the sheets S1 and S2 stably to the respective offset positions. If the forward and backward shift distances are different from each other, the number of the roller bodies 75 and 85 for nipping the seats S1 and S2 may be different. For example, there may be a case where it is one when the discharge rollers pair 51 is shifted to one side while it is three when the discharge rollers pair 51 is shifted to the other side. Then, when the discharge rollers pair 51 is shifted to the one side, the sheets S1 and S2 may not be stably held and discharged. The number of the roller body may be one. Alternatively, the number of the roller body of the first and second rollers 71 and 81 may be different from each other. For example, one first roller body 75 and a plurality of second roller bodies 85 may be provided, and a plurality of nip portions may be formed between both roller bodies. Alternatively, a plurality of first roller bodies 75 and one second roller body 85 may be provided, and a plurality of nip portions may be formed between both roller bodies. In these cases, the number of nip portions corresponds to the number of the plurality of roller bodies.

Further, after the sheet S1 of the first copy and the sheet S2 of the second copy are stacked at the respective offset positions, it is not required to shift the discharge rollers pair 51 to the home position HP when the sheet of the next copy is discharged. In other words, the first discharge position (FIG. 3C) where the sheets of the first copy are discharged) is the same as the second reception position (FIG. 3D) where the sheets of the second copy are received, and the second discharge position (FIG. 3E) where the sheets of the second copy are discharged) is the same as the first reception position (FIG. 3A) where the sheets of the first copy are received. Therefore, it becomes possible to decrease a period required to discharge the sheet.

The shift part 53 which shifts the discharge rollers pair 51 in the width direction is not limited to the above described configuration, and may include a discharge roller unit containing the discharge rollers pair and the drive shaft rotating motor 93, and a shift mechanism for shifting the discharge roller unit in the width direction.

The present disclosure has been described with respect to specific embodiments, the present disclosure is not limited to the above embodiments. The above embodiment can be modified by those skilled in the art without departing from the scope and sprit of the present disclosure.

The invention claimed is:

1. A sheet discharge device which sorts discharged sheets for each copy, the sheet discharge device comprising:

a conveyance member conveying a sheet in a predetermined conveyance direction;

a discharge member shiftable in a width direction crossing to the conveyance direction and discharging the sheet conveyed from the conveyance member to a discharge tray;

a shift part configured to shift the discharge member in the width direction; and a control part configured to carry out a sort processing where the sheet conveyed from the conveyance member is alternately discharged to a first offset position and a second offset position for each copy, the first offset position being separated from a reference discharge position by a first distance in a first direction and the second offset position being separated from the reference discharge position by the first distance in a second direction opposite to the first direction in the width direction, wherein in a case where the sheet is discharged to the first offset position, the control part shifts the discharge member to a first reception position separated from a home position in the second direction by a second distance shorter than the first distance, shifts the discharge member to a first discharge position separated from the first reception position in the first direction by the first distance after the sheet is received by the discharge member, and then discharges the sheet to the first offset position, and in a case where the sheet is discharged to the second offset position, the control part shifts the discharge member to a second reception position separated from the home position in the first direction by the second distance, shifts the discharge member to a second discharge position separated from the second reception position in the second direction by the first distance after the sheet is received by the discharge member, and then discharges the sheet to the second offset position.

2. The sheet discharge device according to claim 1, wherein the second distance is ½ of the first distance.

3. The sheet discharge device according to claim 1, wherein the discharge member is a discharge rollers pair including a first discharge roller having a first roller body fixed to a first rotational shaft extending in the width direction and a second discharge roller having a second roller body fixed to a second rotational shaft extending in the width direction, the second roller body forming at least one nip portion with the first roller body.

4. The sheet discharge device according to claim 3, wherein the first roller body includes a plurality of the first roller bodies supported by the first rotational shaft at predetermined intervals in the width direction, a plurality of the nip portions is formed between the first roller bodies and the second roller body, the sheet is nipped at the nip portions at the home position, and the second distance is equal to or shorter than the predetermined intervals.

5. The sheet discharge device according to claim 3, wherein the second roller body includes a plurality of the second roller bodies supported by the second rotational shaft at predetermined intervals in the width direction, a plurality of nip portions is formed between the first roller body and the second roller bodies, the sheet is nipped at the nip portions at the home position, and the second distance is equal to or shorter than the predetermined intervals.

6. The sheet discharge device according to claim 3, wherein the first roller body includes a plurality of the first roller bodies supported by the first rotational shaft at predetermined intervals in the width direction, the second roller body includes a plurality of the second roller bodies supported by the second rotational shaft at predetermined intervals in the width direction, a plurality of the nip portions is formed between the first roller bodies and the second roller bodies, the sheet is nipped at the nip portions at the home position, and the second distance is equal to or shorter than the predetermined intervals.

7. The sheet discharge device according to claim 3, wherein the sheet is nipped at at least two nip portions at the home position, the first reception position and the second reception position.

8. The sheet discharge device according to claim 1, wherein in the sort processing, a last sheet of the previous copy is discharged by the discharge member shifted to the first discharge position, and then the first sheet of the next copy is received by the discharge member at the first discharge position.

9. An image forming apparatus comprising:

an image forming part forming an image on a sheet; and the sheet discharge member according to claim 1, which discharges the sheet on which the image is formed in the image forming part.

* * * * *